US006877830B2

(12) United States Patent
Salice

(10) Patent No.: US 6,877,830 B2
(45) Date of Patent: Apr. 12, 2005

(54) LIFTING APPARATUS FOR A TWO-LEAF FOLDING FLAP

(75) Inventor: Luciano Salice, Carimate (IT)

(73) Assignee: Arturo Salice S.p.A., Novedrate/Como (IT)

( * ) Notice: Subject to any disclaimer, the term of this patent is extended or adjusted under 35 U.S.C. 154(b) by 0 days.

(21) Appl. No.: 10/047,138

(22) Filed: Jan. 15, 2002

(65) Prior Publication Data

US 2002/0108311 A1 Aug. 15, 2002

(30) Foreign Application Priority Data

Jan. 15, 2001 (DE) ..... 201 00 662 U

(51) Int. Cl.[7] ..... A47B 88/00
(52) U.S. Cl. ..... 312/327; 312/325; 312/319.2
(58) Field of Search ..... 312/319.1, 319.2, 312/322, 323, 325, 327, 319.4; 49/203–206; 160/189, 190, 199

(56) References Cited

U.S. PATENT DOCUMENTS

| | | | | |
|---|---|---|---|---|
| 3,075,819 A | * | 1/1963 | Liegeon et al. | 312/325 |
| 5,882,099 A | * | 3/1999 | Salice | 312/319.2 |
| 5,938,306 A | * | 8/1999 | Lambright et al. | 312/325 |
| 5,971,514 A | * | 10/1999 | Hayakawa | 312/319.2 |
| 6,088,964 A | * | 7/2000 | Scherrer | 49/200 |
| 6,536,860 B1 | * | 3/2003 | Heidmann et al. | 312/319.2 |

FOREIGN PATENT DOCUMENTS

| | | | |
|---|---|---|---|
| DE | 1926846 | | 11/1965 |
| DE | 2930300 | * | 2/1981 |
| DE | 2946352 | * | 5/1981 |
| DE | 3632207 | * | 4/1988 |
| DE | G9403699.3 | | 5/1994 |
| DE | 29604354 | | 6/1996 |
| DE | 851084 | | 7/1998 |
| DE | 20008292 | | 8/2000 |
| DE | 19913435 | | 9/2000 |
| EP | 0794309 | | 9/1997 |
| FR | 1371328 | | 9/1964 |
| HU | 215062 | | 2/1996 |
| LU | 55310 | | 1/1968 |

* cited by examiner

*Primary Examiner*—Lanna Mai
*Assistant Examiner*—Hanh V. Tran
(74) *Attorney, Agent, or Firm*—Dilworth & Barrese, LLP.

(57) ABSTRACT

A lifting apparatus for a two-leaf folding flap, whose upper leaf is hinged to a top or partition wall of a cupboard around a horizontal first axle and whose lower leaf is pivotally connected to the upper leaf around a second axle parallel to the first axle, comprises at least one two-armed lever which is pivotally mounted to a side body part around a horizontal pivot axle and whose longer arm is linked to the lower leaf. One end of the compressing spring element is pivotally connected to the body part and the other end is pivotally connected to the lever. To prevent the leaf from coming into contact with the end surfaces of body parts of the cupboard closed by the folding flap, the lever is guided in a longitudinally displaceable manner on its pivot axle and the shorter lever arm is guided in a cam guide fixed to the body via a slide block or a roller.

28 Claims, 7 Drawing Sheets

LIFTING APPARATUS FOR A TWO-LEAF FOLDING FLAP

BACKGROUND OF THE INVENTION

The invention relates to a lifting apparatus for a two-leaf folding, flap whose upper leaf is hinged around a horizontal first axis at a top wall or partition wall of a cupboard and whose lower leaf is pivotally connected to the upper leaf around a second axis parallel to the first axis, consisting of at least one double-armed lever which is pivotally hinged around a horizontal pivot axis at a side body part of the cupboard and whose longer arm is linked to the lower leaf, and of a compression spring element whose one end is pivotally connected to the body part and whose other end is pivotally connected to the lever.

In a lifting apparatus of this kind known from LU 55 310, the longer arm of the double-armed lever consists of two parts which can be telescoped relative to one another so that the lower leaf of the folding flap can come into contact with the end faces of the side body parts in its movement into the open position and into the closed position by actuation of the handle attached to its front side.

A lifting apparatus is known from DE 296 04 354 U1 for a two-leaf folding flap in which only the upper leaf is provided with a lifting apparatus consisting of a spring-biased bell crank lever and the lower region of the lower leaf linked to the upper leaf is guided in guide rails linked to the side walls of the body part in order to ensure a controlled folding of the two leaves between the closed position and the open position of the leaf. This known lifting apparatus is, however, comparatively complex because special guide devices have to be provided for the lower region of the lower leaf of the folding flap.

SUMMARY OF THE INVENTION

It is the object of the invention to provide a lifting apparatus of the kind first mentioned which can be mounted in a space-saving manner with a simple construction and which ensures a guidance of the lower leaf in the manner that this does not come into contact with the end faces of body parts of the cupboard closed by the folding flap.

This object is solved in accordance with the invention in that the lever is guided in a longitudinally displaceable manner on a pivot axis and the shorter lever arm is guided via a slide block or a roller in a cam guide fixed to the body.

The lifting apparatus of the invention ensures a pivoting of the lower leaf of the folding flap in a form defined by the cam guide so that a coming into contact of the lower leaf with body parts of the cupboard is avoided during the opening movement or the closing movement. This defined guidance is achieved in a simple manner only by the double-armed lever which is controlled by its longitudinal displaceability on the pivot axis and its guiding in the cam guide. The lower leaf is expediently provided with a handle for the opening and closing of the folding flap. As a result of the guidance of the invention, no coming into contact of the lower leaf with body parts can be brought about even by improper pressure on this hand lever during opening and closing.

The cam guide is expediently designed such that the lower edge of the lower leaf is immediately moved away from body parts on the opening of the folding flap. This can be achieved, for example, in that the upper end section of the cam guide is inclined at an acute angle into the inside of the cupboard and the adjacent section of the cam guide extends in a curved form around the pivot axis.

The pivot axis is expediently guided in an elongate aperture of the lever.

The longer lever arm can consist of two parts which can be displaced relative to one another and which can be fixed to one another in order to adapt the lever to different formats of the folding flap.

The spring element is expediently hinged to the longer lever arm.

In accordance with another embodiment, it is provided that the lever is provided with a third arm in the region of the pivot axis, with the spring element being hinged to said third arm.

In accordance with another embodiment, it is provided that the spring element is hinged to an end of a link whose other end is linked to the body part and that a rod is hinged to the link in the manner of a connecting rod between its joints, with the other end of said link being linked to the lever or to a third arm of the lever. The spring force of the spring element acting on the lever can be amplified in this manner.

In accordance with a preferred embodiment, it is provided that the longitudinal axis of the spring element or the rod of a connecting rod type sweeps over the pivot axis of the lever between the opening position and the closed position of the folding flap. In this embodiment, when the spring element has passed through its dead point position, in which its line of force intersects the pivot axis, it supports the holding of the folding flap in the closed position, on the one hand, and the lifting and holding of the folding flap in the open position, on the other hand, with the desired lifting and holding forces being able to be selected by the respective deviation of the spring element from the dead point position.

The spring element is expediently a gas pressure spring.

BRIEF DESCRIPTION OF THE DRAWINGS

Embodiments of the invention are explained in more detail in the following with reference to the drawing. There are shown in this.

DESCRIPTION OF THE PREFERRED EMBODIMENTS

Figure 1:
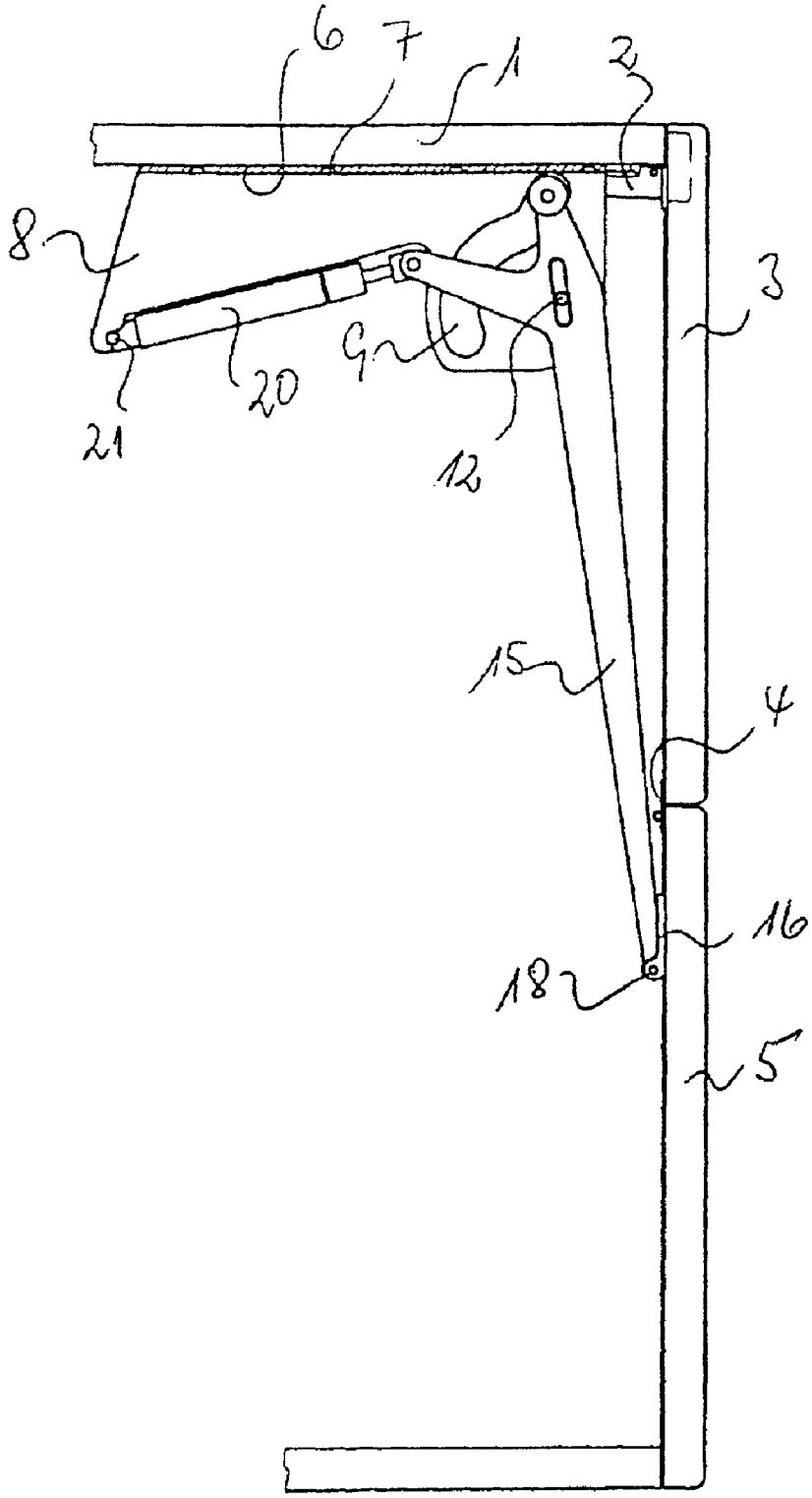
FIG. 1 a side view of a first embodiment of the lifting apparatus of the invention in the closed position of the folding flap connected to this.

A side view of a cupboard or of a cupboard element or an element of a chest of drawers can be seen from FIG. 1, the opening of which is closed by a folding flap consisting of two linked leaves and of the front side wall of which is removed in order to make the lifting apparatus visible. The upper leaf 3 of a folding flap is hinged to the top wall 1 of the cupboard in the usual manner by two dual-link hinges 2 so that said folding flap is pivotable around a horizontal axis defined by the hinges 2. A lower leaf 5 is linked to the upper leaf 3 by a butt hinge 4. Assembly metal sheets 6 which are bent into a U shape and of which a centrally sectioned assembly metal sheet 6 is visible from FIG. 1, is screwed to the top wall 1 in the vicinity of the two side body parts of the cupboard. Each assembly metal sheet is provided with fastening boreholes 7 for fastening screws in its web part. The limb-like side parts 8 of the assembly metal sheet are provided with cam guides 9 which coincide in a side view. These cam guides are provided at their upper end regions with a section 10 extending obliquely in the direction of the cupboard interior and with a curved section 11 adjacent to this which is curved around a pivot axle 12 which is held at the side parts 8. A lever 13 can be pivoted on the pivot axle 12 and is mounted in a longitudinally displaceable manner such that this penetrates an elongate opening 14 of the lever 13. The lever 13 is designed with three arms. A long lever arm 15 is linked at its outer end to a bearing block 16 which is screwed to the lower leaf 5 beneath the butt hinge 4 in the manner shown. A short lever arm 16 disposed in extension of the lever arm 15 is provided at its free end with a transverse axle on which rollers 17 are mounted to both sides of the lever arm 16. These rollers 17 run in the cam guides 9. The elongate opening 14 is disposed on the connecting line between the axle of the rollers 17 and the pivot axis 18 by which the end of the longer lever 15 is mounted at the bearing block 16. The lever 13 is provided in the region of the elongate opening 14 with a third lever arm 19 which extends toward the lever arm 15 at an obtuse angle. The piston rod of a gas compression spring 20 is hinged to the outer end of the lever arm 19 and the cylinder of said gas compression spring 20 is provided with an articulated axle 21 which is hung into recesses 22 of the side parts 8 of the assembly metal sheet.

Figure 2:
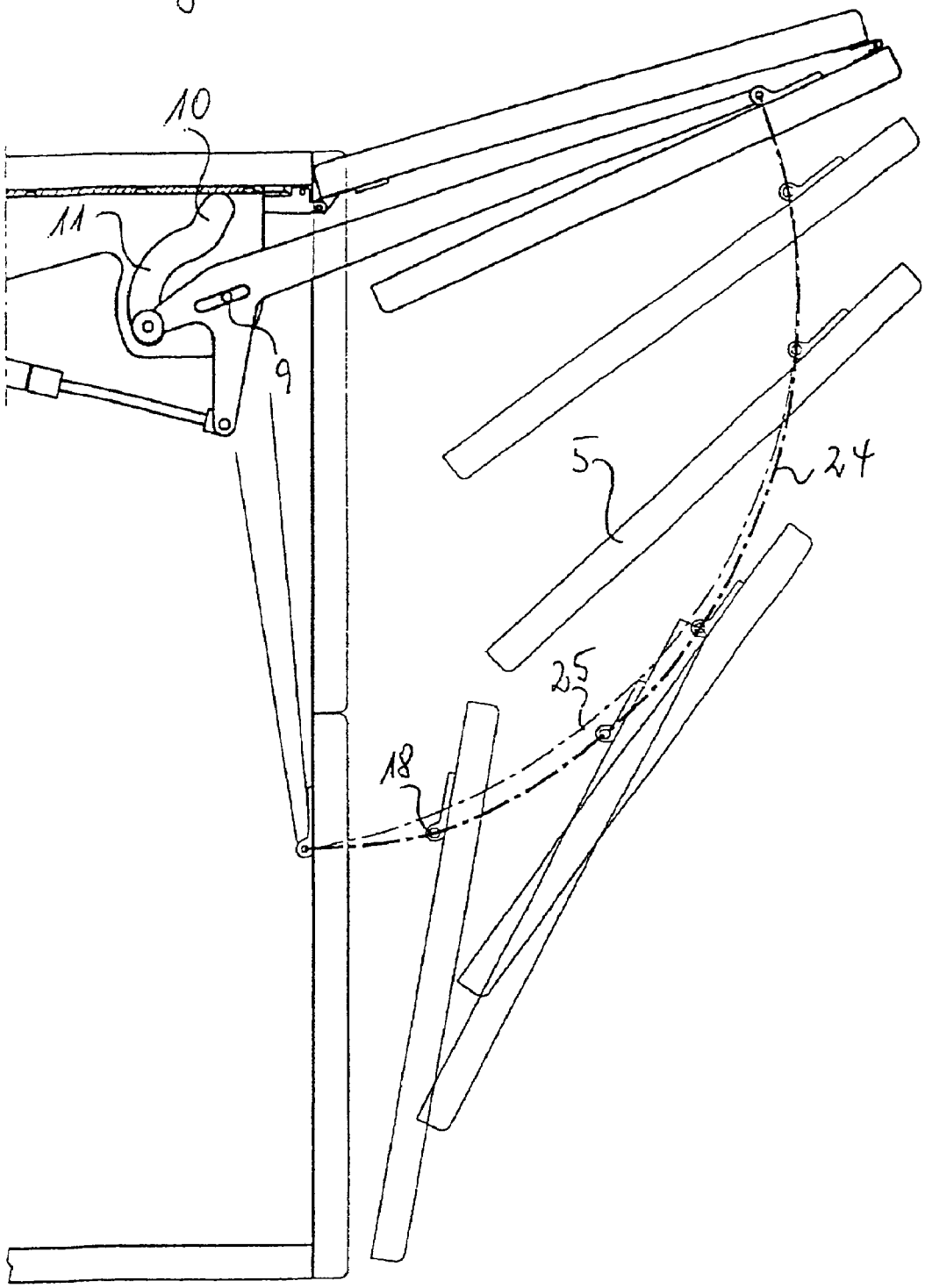
FIG. 2 a representation of the lifting apparatus corresponding to FIG. 1 in which the folding flap is located in its open position, with intermediate positions of the lower leaf of the folding flap during its movement out of the closed position into the open position.
Figure 3:
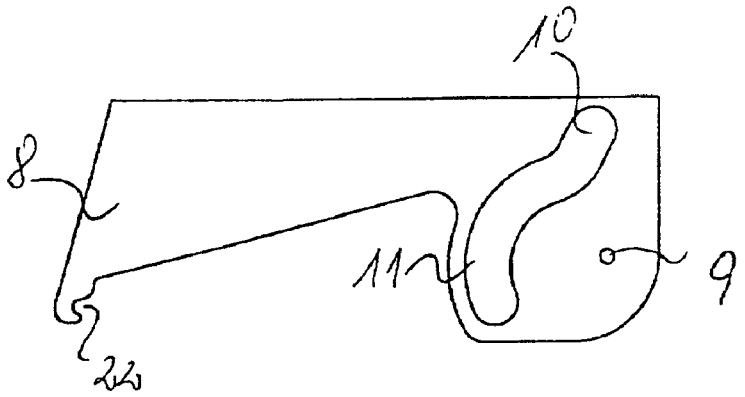
FIG. 3 a side view of the assembly metal sheet of the lifting apparatus with cam guide.
Figure 4:
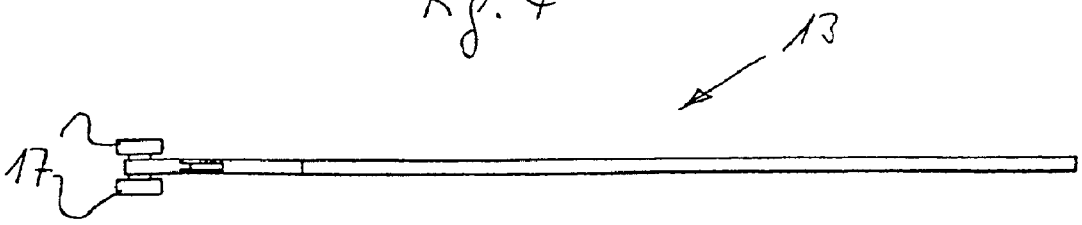
FIG. 4 a plan view of the lever.
Figure 5:
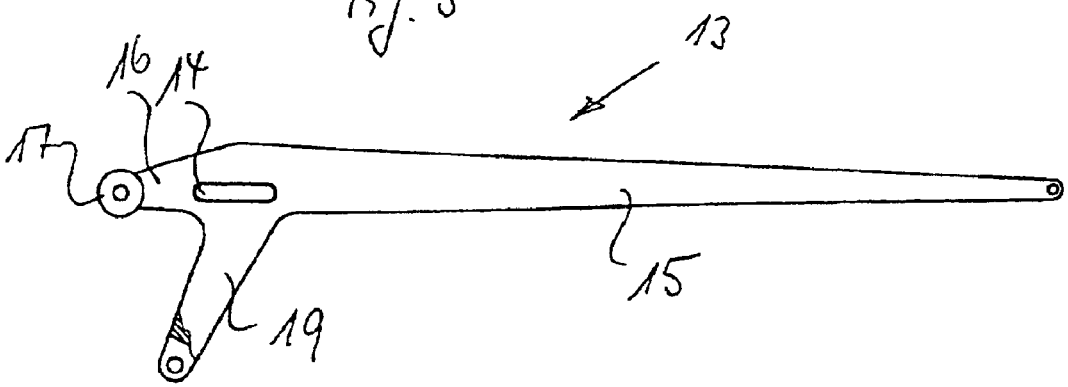
FIG. 5 a side view of the lever in accordance with FIG. 4.

If the folding flap 3, 5 is opened in that a person grips a lever (not shown) connected to the lower flap 5, the folding flap is pivoted out of its closed position visible in FIG. 1 into the open position visible in FIG. 2, with the lower leaf being pivoted away from the side walls of the body part of the cupboard right at the start of the opening movement due to the straight and obliquely extending cam section so that it cannot come into contact with the body part. The articulated axle 18 of the lever arm 15 mounted at the bearing block 16 extends due to the curve characteristic of the cam guide 9 on the thick, chain-dotted line 24 which deviates from the chain-dotted line 25 which is curved concentrically around the pivot axis 9.

Due to the longitudinal displaceability of the two-armed lever 15, 16 on the pivot axle 12 and the rollers 17 running in the cam guide 9, a mandatory guiding of the lower leaf 5 of the folding flap results which ensures a pre-determined pivot movement of the lower leaf 5 between the opening position and the closing position.

In the embodiment in accordance with FIGS. 6 to 12, the longer lever arm of the lever 30 is formed in a longitudinally changeable manner in that it is formed in two parts, namely consisting of a part 31 in which a part 32 is longitudinally displaceable and is guided in a manner fixable in desired positions. The parts 31, 32 consist of sheet metal parts which are bent in a U shape and which are guided in one another in telescope-like manner. The limbs of the part 31 are provided with elongate openings 33, which lie in one plane and in which the guide pins 34 of the displaceable part engage, to guide the part 32 in the part 31. The part 32 is provided with an elongate opening 36 in its web part 35, while the web part 37 of the part 31 is provided with a tapped borehole 38. A setting screw 39 is screwed through the elongate opening 36 into the tapped borehole 38 to fix the two parts 31, 32 to one another in the desired position.

Figure 6:
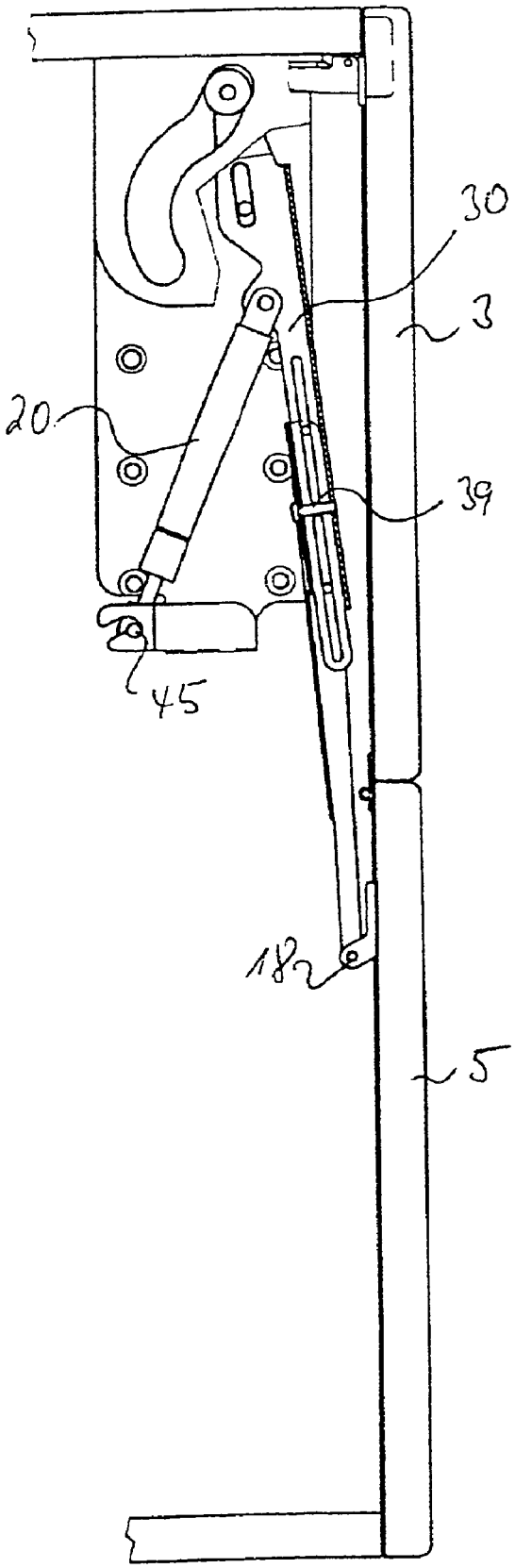
FIG. 6 a side view of a second embodiment of the lever apparatus of the invention in the closed position of the folding flap connected to this.
Figure 7:
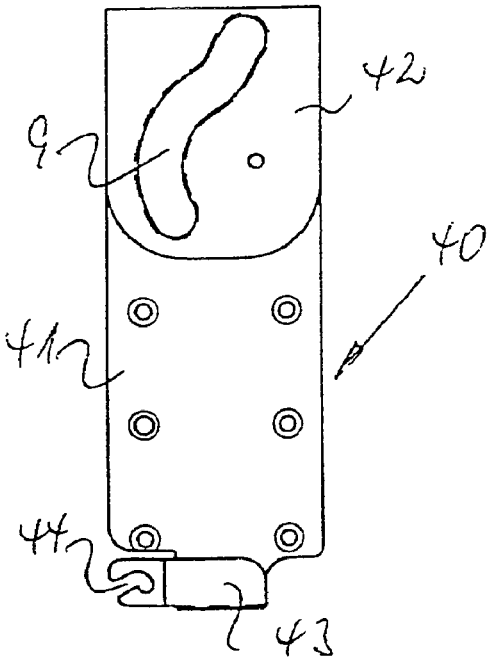
FIGS. 7 to FIG. 12 individual parts of the lifting apparatus in accordance with FIG. 6.
Figure 8:
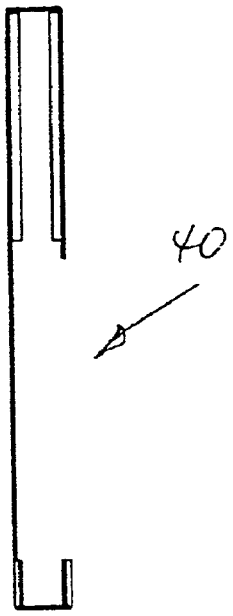
Figure 9:
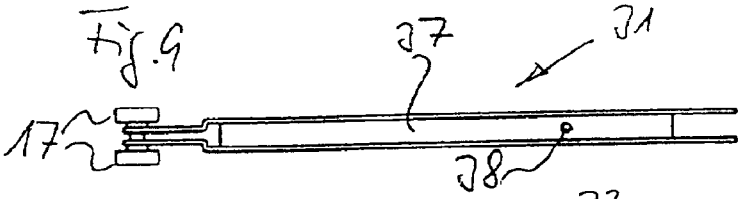
Figure 10:
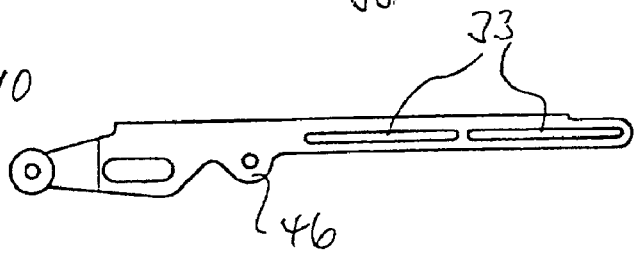
Figure 11:
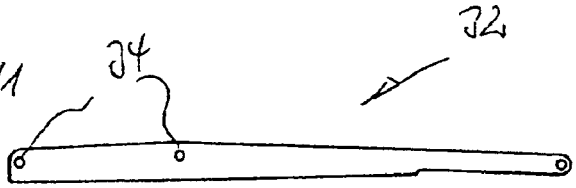
Figure 12:
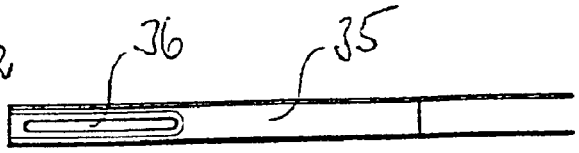

The assembly metal sheet 40 of the lifting apparatus in accordance with FIG. 6 consists of a plate-shaped part 41 which is provided with fastening boreholes, which can be screwed to the side body parts and from whose upper and lower ends U shaped limbs 42, 43 are bent. The cam guide 9 is worked with a flanged edge into the plate-shaped part 41 and the limb 42. Furthermore, the limb 43 and the opposed plate-shaped part 41 are provided at crimped end regions with hook-shaped cut-outs 44 which mutually coincide in a side view and serve the acceptance of the holding axle 45 of the gas compressing spring 20 at the end side. The piston rod of the gas compression spring 20 is linked in the manner visible from FIG. 6 to a side projection 46 of the longer lever arm of the lever 30.

Figure 13:
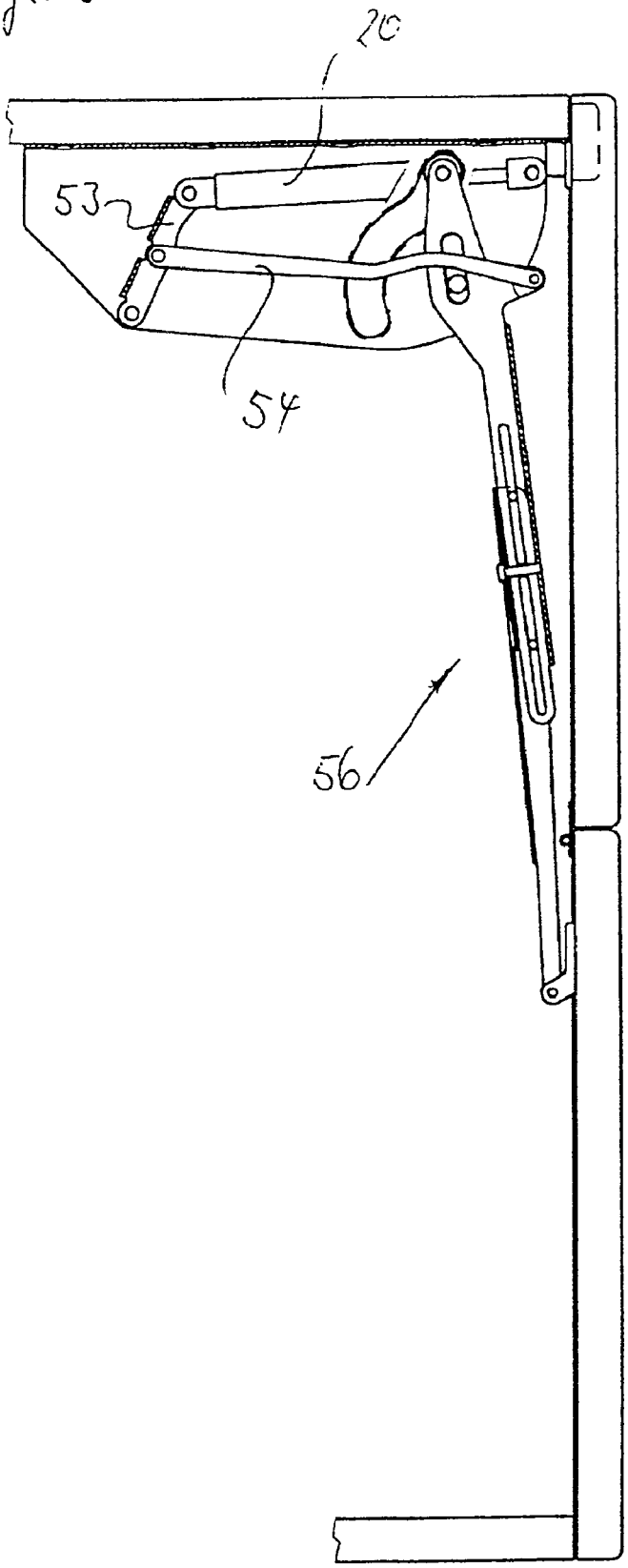
FIG. 13 a side view of a third embodiment of the lifting apparatus of the invention in the closed position of the holding flap connected to this.
Figure 14:
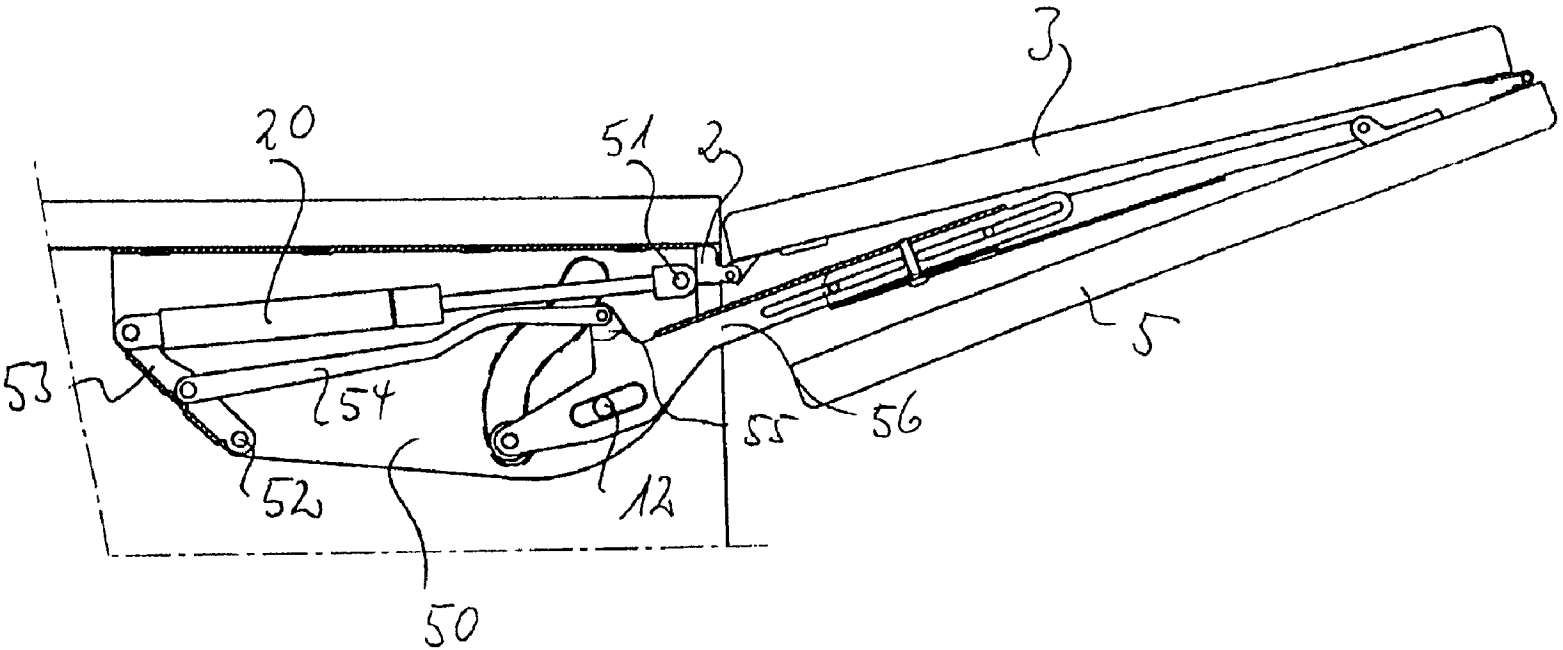
FIG. 14 a representation of the lifting apparatus in accordance with FIG. 13, in which the folding flap is located in its open position.
Figure 15:
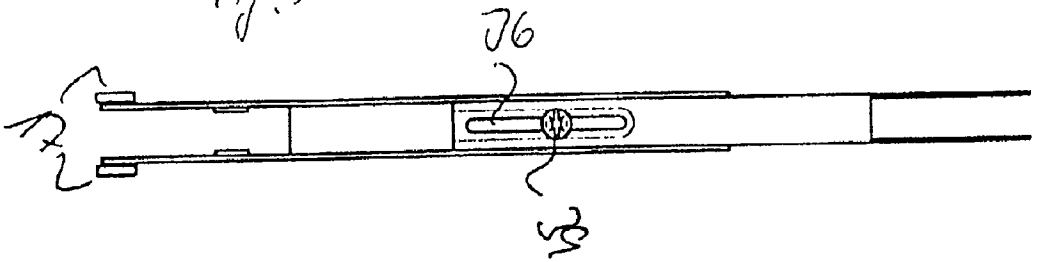
FIG. 15 a plan view of the longitudinally adjustable lever of the lifting apparatus in accordance with FIG. 14.

In the embodiment in accordance with FIGS. 13 to 15, the aspect of the lever with the extendable longer lever arm generally corresponds to the embodiment in accordance with FIGS. 6 to 12. However, a difference arises from the kind of arrangement of the gas compression spring 20. The piston rod of the gas compression spring 20 is pivotally mounted on a pin 51 close to the dual-link hinges 2, said pin 51 being fastened in the side parts 50 of the assembly metal sheet. A link 53 is pivotally mounted on a pin 52 at the opposite ends of the side parts 50, with the cylinder of the gas compression spring 20 being supported at the opposite end of said pin 52. A rod 54 is hinged in the central region of the link 53 and its other end is pivotally connected to an arm-like projection 55 of the lever 56. The force of the gas compression spring acting on the lever 56 is increased by this kind of hinging of the gas compression spring by a gear connection.

What is claimed is:

1. A lifting apparatus for a two-leaf folding flap having an upper leaf (3) structured and arranged to be hinged to a top or partition wall (1) of a cupboard around a horizontal first axle (2) and a lower leaf (5) structured and arranged to be pivotally connected to the upper leaf (3) around a second axle (4) parallel to the first axle (2), comprising at least one two-armed lever (13, 30, 56) which is structured and arranged to be pivotally mounted to a side body part (8) around a horizontal pivot axle (12) and having a longer arm (15) structured and arranged to be linked to the lower leaf (5); and a compression spring element (20) having one end structured and arranged to be pivotally connected to said body part (8) and an opposite end structured and arranged to be pivotally connected to said lever (13, 30, 56);

wherein said lever (13, 30, 56) is structured and arranged to be guided in a longitudinally displaceable manner on said pivot axle (12) and has a shorter arm (16) structured and arranged to be guided in a cam guide (9) fixed to said body part (8) via a slide block or a roller (17).

2. A lifting apparatus in accordance with claim 1, wherein an upper end section (10) of said cam guide (9) inclined at an acute angle with respect to an inside of the cupboard and an adjacent section (11) of said cam guide (9) extends in curved form around said pivot axle (12).

3. A lifting apparatus in a accordance with claim 1, wherein said pivot axle (12) penetrates an elongate opening (14) of said lever (13, 30).

4. A lifting apparatus in accordance with claim 1, wherein said longer lever arm (30) comprises two parts (31, 32) which are structured and arranged to be displaceable relative to one another and fixable to one another.

5. A lifting apparatus in accordance with claim 1, wherein said spring element (20) is hinged to said longer lever arm (31, 32).

6. A lifting apparatus in accordance with claim 1, wherein said lever (13) is provided in a region of said pivot axle (12) with a third arm (19) to which said spring element (20) is hinged.

7. A lifting apparatus in accordance with claim 1, wherein said spring element (20) is hinged to one end of a link (53) having an opposite end linked to said body part (50) and a rod (54) is hinged at one end to said link (53), between its joints, with an opposite end being linked to said lever (50) or to a third arm (55) of said lever (56).

8. A lifting apparatus in accordance with claim 7, wherein a longitudinal axis of said spring element (20) or rod (54) sweeps over said pivot axle (12) of said lever (50) between closed and open positions of the folding flap.

9. A lifting apparatus in accordance with claim 1, wherein said spring element is a gas compression spring (20).

10. A lifting apparatus in accordance with claim 4, wherein said two parts (31, 32) of said longer lever arm (30) are each bent in a U shape and guided in one another in a telescopic manner.

one (31) of said two parts (31, 32) being provided with elongate openings (33) which lie in one plane, and said other (32) of said two parts (31, 32) having guide pins (34) structured and arranged to seat in said respective elongate openings (33) to displaceably guide said other part (32) in said one part (31).

11. A lifting apparatus in accordance with claim 10, wherein a web part (35) of said one part (31) is provided with an elongate opening (36) and a web part (37) of said other part (32) is provided with a tapped borehole (38), such that a setting screw (39) can be screwed through said elongate opening (36) into said tapped borehole (38) to fix said two parts (31, 32) to one another in desired position.

12. A lifting apparatus in accordance with claim 11, wherein said body part (40) is in the shape of a plate-shaped part (41) provided with fastening boreholes and having U shaped limbs (42,43) bent from respective upper and lower ends, said cam guide (9) being positioned with a flanged edge into said plate-shaped part (41) and one (42) of said limbs (42, 43), said opposite limb (43) and plate-shaped part (41) being provided, at crimped end regions, with hook-shaped cutouts (44) mutually coinciding in a lateral direction, said spring element (20), comprising a holding axle (45) arranged to seat in said cutouts (44) and be retained therein, and said longer lever arm (30) comprises a side projection (46) to which a piston rod of said spring element (20) is linked.

13. A lifting apparatus in accordance with claim 9, wherein said body part (40) is in the shape of a plate-shaped part (41) provided with fastening boreholes and having U shaped limbs (42,43) bent from respective upper and lower ends, said cam guide (9) being positioned with a flanged edge into said plate-shaped part (41) and one (42) of said limbs (42,43).

said opposite limb (43) and plate-shaped part (41) being provided, at crimped end regions, with hook-shaped cutouts (44) mutually coinciding in a lateral direction, said spring element (20), comprising a holding axle (45) arranged to seat in said cutouts (44) and be retained therein, and said longer lever arm (30) comprises a side projection (46) to which a piston rod of said spring element (20) is linked.

14. A lifting apparatus in accordance with claim 10, wherein said body part (40) is in the shape of a plate-shape part (41) provided with fastening boreholes and having U shaped limbs (42,43) bent from respective upper and lower ends, said cam guide (9) being positioned with a flanged edge into said plate-shaped part (41) and one (42) of said limbs (42, 43), said opposite limb (43) and plate-shaped part (41) being provided, at crimped end regions, with hook-shaped cutouts (44) mutually coinciding in a lateral direction, said spring element (20), comprising a holding axle (45) arranged to seat in said cutouts (44) and be retained therein, and said longer lever arm (30) comprises a side projection (46) to which a piston rod of said spring element (20) is linked.

15. The combination of a two-leaf folding flap and lifting apparatus therefor, comprising an upper leaf (3) structured and arranged to be hinged to a top or partition wall (1) of a cupboard around a horizontal first axle (2), a lower leaf (5) structured and arranged to be pivotally connected to said upper leaf (3) around a second axle (4) parallel to said first axle (2), at least one two-armed lever (13, 30, 56) which is structured and arranged to be pivotally mounted to a side body part (8) around a horizontal pivot axle (12) and having a longer arm (15) linked to said lower leaf (5) and a short arm (16), a compression spring element (20) having one end pivotally connected to said body part (8) and an opposite end pivotally connected to said lever (13, 30, 56), said lover being guided in a longitudinally displaceable manner on said pivot axle (12), a cam guide (9) fixed to said body part (8), and a slide block or roller (17) for guiding said shorter arm (16) in said cam guide (9).

16. The combination in accordance with claim 1, wherein an upper end section (10) of said cam guide (9) is inclined at an acute angle with respect to an inside of the cupboard and an adjacent section (11) of said cam guide (9) extends in curved form around said pivot axle (12).

17. The combination in accordance with claim 15, wherein said pivot axle (12) penetrates an elongate opening (14) of said lever (13, 30).

18. The combination in accordance with claim 15, wherein said longer lever arm (30) comprises two parts (31, 32) which are structured and arranged to be displaceable relative to one another and fixable to one another.

19. The combination in accordance with claim 15, wherein said spring element (20) is hinged to longer lever arm (31, 32).

20. The combination in accordance with claim 15, wherein said lever (13) is provided in a region of said pivot axle (12) with a third arm (19) to which said spring element (20) is hinged.

21. The combination in accordance with claim 15, wherein said spring element (20) is hinged to one end of a link (53) having an opposite end linked to said body part (50) and a rod (54) is hinged at one end to said link (53), between its joints, with an opposite end being linked to said lever (50) or to a third arm (55) of said lever 56.

22. The combination in accordance with claim 21, wherein a longitudinal axis of said spring element (20) or rod (54) sweeps over said pivot axle (12) of said lever (50) between closed and open positions of the folding flap.

23. The combination in accordance with claim 15, wherein said spring element is a gas compression spring (20).

24. The combination in accordance with claim 18, wherein said two parts (31, 32) of said longer lever arm (30) are each bent in a U shape and guided in one another in a telescopic manner, one (31) of said two parts (31, 32) being provided elongate openings (33) which lie in one plane, and said other (32) of said two parts (31, 32) having guide pins (34) structured and arranged to seat in said respective elongate openings (33) to displaceably guide said other part (32) in said one part (31).

25. The combination in accordance with claim 24, wherein a web part (35) of said one part (31) is provided with an elongate opening (36) and a web part (37) of said other part (32) is provided with a tapped borehole (38), such that a setting screw (39) can be screwed through said elongate opening (36) into said tapped borehole (38) to fix said two parts (31, 32) to one another in desired position.

26. The combination in accordance with claim 25, wherein said body part (40) is in the shape of a plate-shape part (41) provided with fastening boreholes and having U shaped limbs (42, 43) be from respective upper and lower ends, said cam guide (9) being positioned with a flanged edge into said plate-shaped part (41) and one (42) of said limbs (42, 43), said opposite limb (43) end plate-shaped part (41) being provided, at crimped end regions, with hook-shaped cutouts (44) mutually coinciding in a lateral direction, said spring element (20), comprising a holding axle (45) arranged to seat in said cutouts (44) and be retained therein, and said longer lever arm (30) comprises a side projection (46) to which a piston rod of said spring element (20) is linked.

27. The combination in accordance with claim 23, wherein said body part (40) is in the shape of a plate-shaped part (41) provided with fastening boreholes and having U shaped limbs (42,43) bent from respective upper and lower ends, said cam guide (9) being positioned with a flanged edge into said plate-shaped part (41) and one (42) of said limbs (42, 43), said opposite limb (43) and plate-shaped part (41) being provided, at crimped end regions, with hook-shaped cutouts (44) mutually coinciding in a lateral direction, said spring element (20), comprising a holding axle (45) arranged to seat in said cutouts (44) and be retained therein, and said longer lever arm (30) comprises a side projection (46) to which a piston rod of said spring element (20) is linked.

28. The combination in accordance with claim 24, wherein said body part (40) is in the shape of a plate-shaped part (41) provided with fastening boreholes and having U shaped limbs (42,43) bent from respective upper and lower ends, said cam guide (9) being positioned with a flanged edge into said plate-shaped part (41) and one (42) of said limbs (42, 43), said opposite limb (43) and plate-shaped part (41) being provided, at crimped end regions, with hook-shaped cutouts (44) mutually coinciding in a lateral direction, said spring element (20), comprising a holding axle (45) arranged to seat in said cutouts (44) and be retained therein, and said longer lever arm (30) comprises a side projection (46) to which a piston rod of said spring element (20) is linked.

* * * * *